US010246311B2

(12) United States Patent
Bulling et al.

(10) Patent No.: US 10,246,311 B2
(45) Date of Patent: Apr. 2, 2019

(54) WINCH

(75) Inventors: Johannes Bulling, Bad Waldsee (DE); Erich Harsch, Ochsenhausen (DE)

(73) Assignee: Liebherr-Components Biberach GmbH, Biberach an der Riss (DE)

( * ) Notice: Subject to any disclaimer, the term of this patent is extended or adjusted under 35 U.S.C. 154(b) by 670 days.

(21) Appl. No.: 13/809,404

(22) PCT Filed: Jul. 1, 2011

(86) PCT No.: PCT/EP2011/003274
§ 371 (c)(1),
(2), (4) Date: Jan. 9, 2013

(87) PCT Pub. No.: WO2012/007112
PCT Pub. Date: Jan. 19, 2012

(65) Prior Publication Data

US 2013/0112931 A1 May 9, 2013

(30) Foreign Application Priority Data

Jul. 13, 2010 (DE) ..... 10 2010 026 968

(51) Int. Cl.
*B66D 1/02* (2006.01)
*B66D 1/12* (2006.01)
*B66D 1/22* (2006.01)
*B66D 1/54* (2006.01)

(52) U.S. Cl.
CPC ..... *B66D 1/02* (2013.01); *B66D 1/12* (2013.01); *B66D 1/22* (2013.01); *B66D 1/54* (2013.01)

(58) Field of Classification Search
CPC ... B66D 1/02; B66D 1/12; B66D 1/22; B66D 1/54
USPC ..... 254/290, 293, 340–342, 345–346, 370, 254/375
See application file for complete search history.

(56) References Cited

U.S. PATENT DOCUMENTS 1,251,289 A * 12/1917 Sawyer ..... 254/290
1,395,735 A * 11/1921 Sawyer ..... 254/290
1,958,037 A * 5/1934 Engler ..... 254/290
2,271,428 A * 1/1942 Harry ..... 254/290
2,370,855 A * 3/1945 Fox ..... 254/340
2,462,484 A * 2/1949 Fox ..... 254/340
(Continued)

FOREIGN PATENT DOCUMENTS

BE 490709 A 8/1945
DE 2709089 A1 9/1977
(Continued)

OTHER PUBLICATIONS

ISA European Patent Office, International Search Report of PCT/EP2011/003274, dated Sep. 22, 2011, Netherlands, 9 pages.

*Primary Examiner* — Michael E Gallion
(74) *Attorney, Agent, or Firm* — McCoy Russell LLP

(57) ABSTRACT

The present invention relates to a winch, in particular a luffing winch, with a winch drum, at least one main drive driving the transmission input shaft, and at least one emergency drive driving the transmission input shaft in case of emergency, wherein at least one emergency drive can be coupled to the driven wheel of the transmission input shaft as required via at least one intermediate gear. The present invention furthermore is directed to a construction machine or a lifting device with at least one such winch.

19 Claims, 4 Drawing Sheets

(56) References Cited

U.S. PATENT DOCUMENTS

| | | | | | |
|---|---|---|---|---|---|
| 2,803,973 | A | | 8/1957 | Ashton | |
| 3,218,034 | A | * | 11/1965 | Schat | 254/290 |
| 3,661,279 | A | * | 5/1972 | Macrander | 414/137.7 |
| 3,698,690 | A | * | 10/1972 | Beaver | 254/340 |
| 3,744,760 | A | * | 7/1973 | Uher | 254/351 |
| 4,123,040 | A | * | 10/1978 | Kuzarov | 254/342 |
| 4,132,387 | A | * | 1/1979 | Somerville et al. | 254/340 |
| 4,177,973 | A | * | 12/1979 | Miller et al. | 254/276 |
| 4,493,479 | A | * | 1/1985 | Clark | 254/274 |
| 4,518,153 | A | * | 5/1985 | West et al. | 254/274 |
| 4,625,946 | A | * | 12/1986 | Clark et al. | 254/274 |
| 4,653,653 | A | * | 3/1987 | Scott | 212/278 |
| 4,974,814 | A | * | 12/1990 | Cundy | 254/345 |
| RE33,898 | E | * | 4/1992 | Santos | 114/210 |
| 5,271,608 | A | * | 12/1993 | Kubono | 254/372 |
| 6,966,544 | B2 | * | 11/2005 | McCormick et al. | 254/342 |
| 7,806,386 | B2 | * | 10/2010 | Yang et al. | 254/342 |
| 7,891,641 | B1 | * | 2/2011 | Miller | 254/346 |
| 2003/0111654 | A1 | * | 6/2003 | Huang | 254/344 |
| 2003/0127635 | A1 | * | 7/2003 | Morse et al. | 254/268 |
| 2003/0213945 | A1 | * | 11/2003 | Vado et al. | 254/339 |
| 2006/0022182 | A1 | * | 2/2006 | Blanc | 254/293 |
| 2006/0097236 | A1 | * | 5/2006 | Copeman | 254/361 |
| 2008/0045374 | A1 | * | 2/2008 | Weinberg et al. | 475/342 |
| 2008/0078981 | A1 | * | 4/2008 | Huang | 254/375 |
| 2010/0102288 | A1 | * | 4/2010 | Yang et al. | 254/356 |
| 2010/0224844 | A1 | * | 9/2010 | Boussaton et al. | 254/290 |
| 2010/0273597 | A1 | * | 10/2010 | Wilson, Jr. | 475/149 |
| 2012/0110992 | A1 | * | 5/2012 | Zheng | 60/435 |

FOREIGN PATENT DOCUMENTS

| | | | |
|---|---|---|---|
| DE | 3933505 | A1 | 4/1990 |
| DE | 4310770 | A1 | 10/1994 |
| FR | 886971 | A | 10/1943 |
| FR | 2236773 | A1 | 2/1975 |
| GB | 1211437 | A | 11/1970 |
| JP | 6283098 | U | 5/1987 |
| RU | 2287479 | C1 | 11/2006 |
| WO | 8500581 | A1 | 2/1985 |

* cited by examiner

WINCH

CROSS REFERENCE TO RELATED APPLICATIONS

This is the U.S. National Phase of International PCT Application Serial No. PCT/EP2011/003274, entitled "Winch," filed Jul. 1, 2011, which claims priority to German Patent Application No. 10 2010 026 968.9, entitled "Winch," filed Jul. 13, 2010, both of which are hereby incorporated by reference in their entirety for all purposes.

TECHNICAL FIELD

The present invention relates to a winch with a winch drum, a main drive driving the transmission input shaft, and an emergency drive driving the transmission input shaft in case of emergency.

BACKGROUND AND SUMMARY

The term cable winch generally includes devices which apply a certain tensile or hoisting force onto a corresponding object by means of a cable. The cable mostly is wound up on a cylindrical drum driven by a motor.

Up to now, the winches have been constructed of individual components. The input shaft of the spur-gear transmission is of the continuous type, wherein at the end the main drive of the cable winch is attached. In case of a possible defect at the main drive, a safety braking system is actuated and an emergency drive possibly is activated for the emergency operation of the winch. In known luffing winches, this emergency drive can be coupled to the second shaft end via a switchable clutch.

Such cable winches have been used for years as versatile hoisting and pulling winches in a broad spectrum of applications. Due to the design of these luffing winches as compact cable winches, the construction of these winches could be improved in terms of ruggedness and simplicity. The overall size of the compact winches was significantly shortened by a planetary transmission protected inside the drum. Motor, brake, transmission and drum are arranged coaxially to each other. A disadvantage of this construction, however, consists in that the switchable clutch of the emergency drive at the opposite shaft end only is possible to a limited extent or even is impossible.

Therefore, it is the object of the present invention to provide an alternative solution for coupling an emergency drive to a compact cable winch, as required.

This object is solved by the combination of a winch, in particular a luffing winch, with a winch drum, at least one main drive driving the drum shaft and at least one emergency drive driving the drive shaft in case of emergency, characterized in that at least one emergency drive can be coupled to the driven wheel of the drum shaft as required via at least one mechanical transmission element or a mechanical transmission unit.

According to claim 1, there is proposed a winch with a winch drum, a main drive driving the transmission input shaft, and an emergency drive driving the transmission input shaft in case of emergency. When the winch according to the invention, in particular the luffing winch, is designed as compact winch, winch drum and main drive preferably are arranged coaxially to each other. Furthermore, when designed as compact winch, the driving transmission as well as the braking device preferably likewise are arranged coaxially to the main drive and the winch drum. Particularly preferably, a planetary transmission is interposed between main drive and winch drum for driving the compact winch.

According to the invention, at least one mechanical transmission element or at least one mechanical transmission unit, in particular in the form of at least one intermediate gear, is provided, in order to couple the emergency drive to the driven wheel of the transmission input shaft, as required. The power transmission from the drive wheel of the emergency drive accordingly is effected via the interposed intermediate gear to the driven wheel of the transmission input shaft. Instead of one or more intermediate gears, the power transmission in accordance with the invention also can be effected via chain elements, toothed belts or the like.

Advantageously, the intermediate gear is shiftably mounted for coupling in and out. Preferably, the intermediate gear is shiftably mounted in direction of its shaft axis. Accordingly, the intermediate gear can be shifted into a position coupled in, which provides for a power transmission from the drive wheel of the emergency drive to the driven wheel of the transmission input shaft. The movement of the intermediate gear into the position coupled out leads to an interruption of the power transmission from the emergency drive to the transmission input shaft.

Coupling the provided intermediate gear in and out preferably is effected via a lever mechanism to be actuated manually or automatically. The lever actuation brings the intermediate gear in engagement with the drive wheel or the driven wheel. It is conceivable that the lever mechanism is accessible for the user from outside. When a defect occurs at the main drive, the user can actuate the lever quickly and easily and switch the winch over to the emergency drive.

To prevent an inadvertent shift in position of the intermediate gear during operation of the winch, at least one locking means preferably is provided for fixing the intermediate gear position. For example, an engagement of the emergency drive into the drive train of the shaft thereby is inhibited in normal operation. Furthermore, it is ensured that during the emergency operation the flux of force from the emergency drive to the transmission input shaft is interrupted by a displacement of the intermediate gear. Particularly preferably, a locking bolt to be actuated manually is suitable as locking means, which inhibits any displacement of the intermediate gear along its shaft axis.

An optimum power transmission advantageously is ensured by a roof-like toothing of the intermediate gear and of the driven wheel of the transmission input shaft. Furthermore the roof-like toothing allows a smooth positioning of the intermediate gear for engagement into the driven wheel of the transmission input shaft.

In a preferred embodiment of the invention the drive wheel of the emergency drive includes a hexagon as an additional possibility for adjustment. This adjustment possibility allows the optimization of the flux of force from the emergency drive to the transmission input shaft. In particular, the engagement of the drive wheel of the emergency drive into the intermediate gear can be readjusted and optimized.

For communicating the respective position of the intermediate gear to the winch controller, one or more inductive transmitters are provided. In this way, it can in particular be detected whether or not the intermediate gear is in engagement with the drive wheel and driven wheel of the emergency drive train. One or more inductive transmitters expediently are arranged in the region of the intermediate gear shaft.

When the main drive is blocked mechanically in case of a defect, means for decoupling the main drive from the drive train of the transmission input shaft preferably are provided. In particular, the main drive can be disengaged from the drive train of the transmission input shaft by means of slotted spacer bushes, so as to inhibit the non-positive connection. Preferably, the means for decoupling or the slotted spacer bushes effect a displacement of the main drive in direction of the shaft axis, in particular in a direction opposite to the transmission input shaft. The main drive accordingly is moved away from the transmission input shaft on the shaft axis.

It is particularly advantageous when the gear wheels are coated. The emergency running properties (dry running) generally are improved thereby. The coefficient of friction thereby is minimized, and noise and wear are reduced.

The present invention furthermore is directed to a construction machine or a lifting device which includes at least one winch, in particular luffing winch, according to any of the aforementioned combinations of features.

Further advantages and details of the invention will be explained in detail below with reference to drawings.

DETAILED DESCRIPTION

Figure 1:
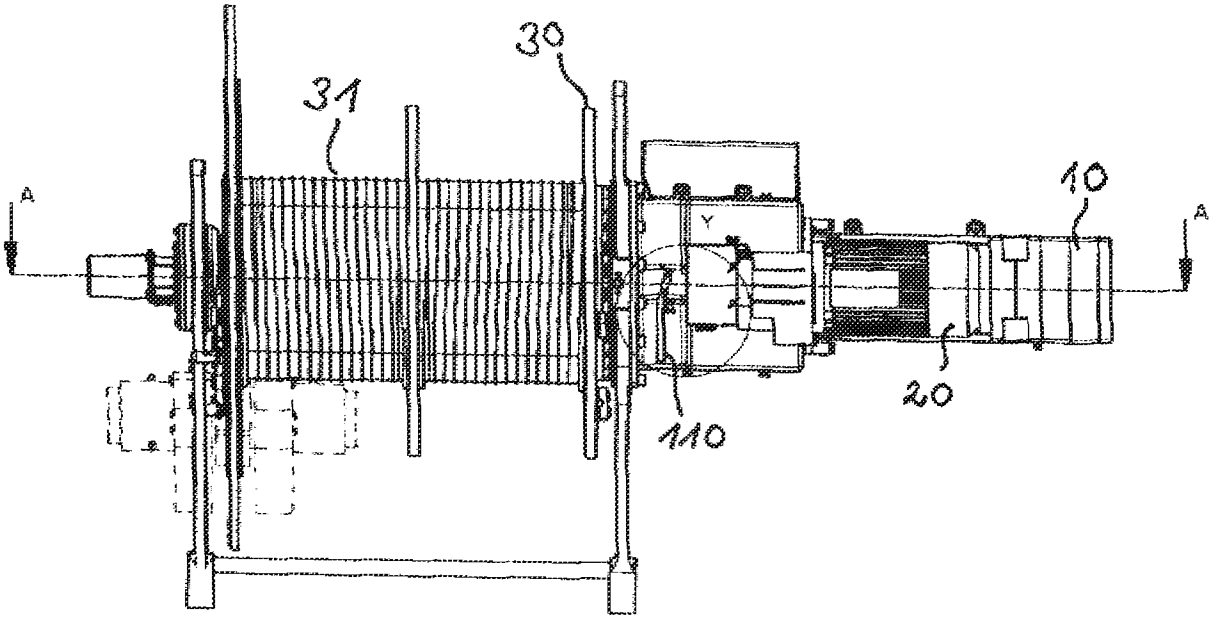
FIG. 1 shows a side view of the luffing winch according to the invention.

FIG. 1 shows an overall view of the luffing winch according to the invention in a side representation. The luffing winch according to the invention was designed as compact winch with a planetary transmission not shown in detail. The main drive 10 as well as the brake disk 60 of the braking device 40, the planetary transmission and the winch drum 30 are arranged coaxially to each other. On the drum winch 30 the winch cable 31 is wound up in the usual way. In case of need, i.e. upon occurrence of a technical defect of the main drive 10, the emergency drive 20 can be activated for safety. For the emergency operation, the same can be coupled to the drive train of the winch drum 30 by means of the lever mechanism 110. The luffing winch is constructed such that the emergency drive 20 will only be running when necessary, i.e. in the emergency operation. When the main drive 10 is blocked mechanically, it can additionally be disengaged by means of certain means and the flux of force to the drive train of the luffing winch will be interrupted.

The braking device 40 has the advantage that due to the special arrangement the brake is usable for both modes, namely the normal hoisting operation and the emergency operation, and thus no additional drive must be provided. In this embodiment, the braking device 40 furthermore has the advantage that it provides for load-free switching, since the transmission moment is applied to the brake, but not to the drives.

The braking device 40 can be designed for example as multidisk brake, drum brake or as electromechanical vortex brake. A brake integrated into the transmission preferably can be designed as multidisk brake.

Figure 2:
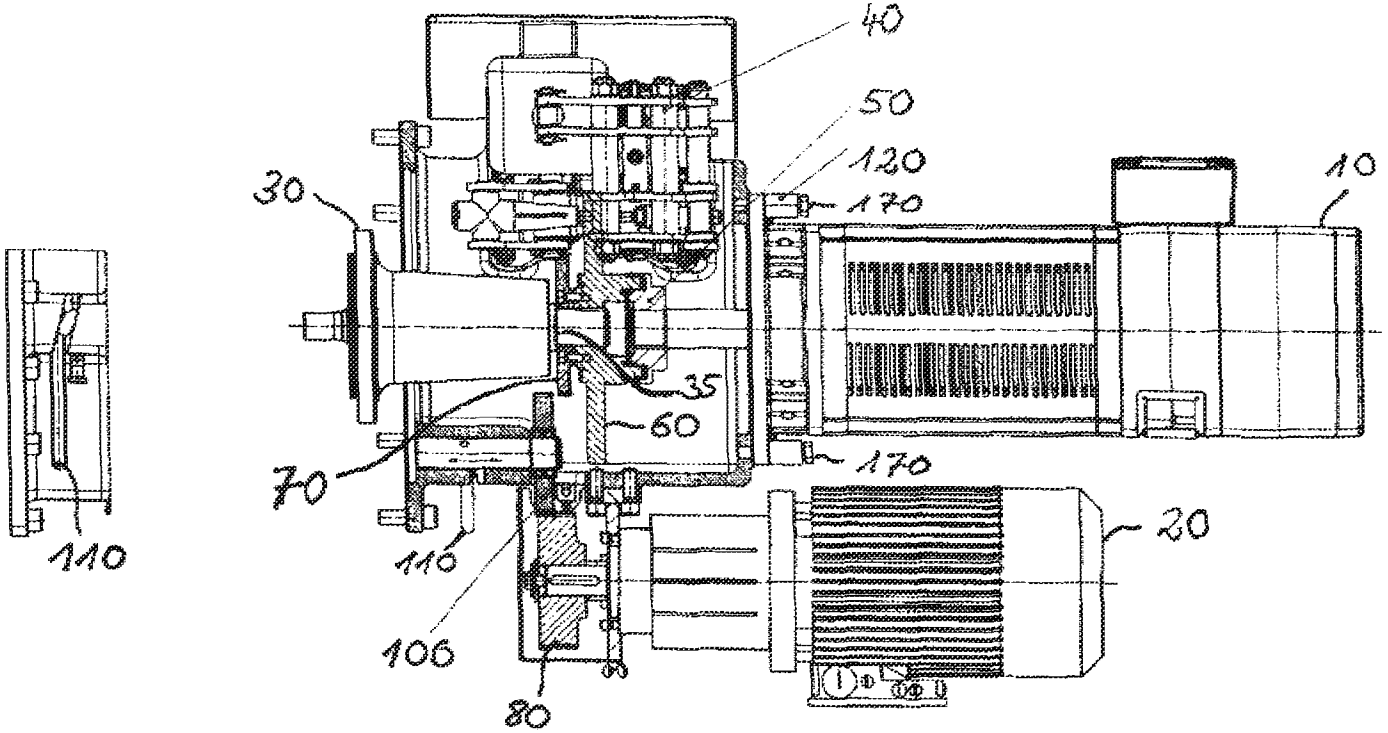
FIG. 2 shows a sectional representation along the sectional axis A-A of the luffing winch according to the invention as shown in FIG. 1.
Figure 3:
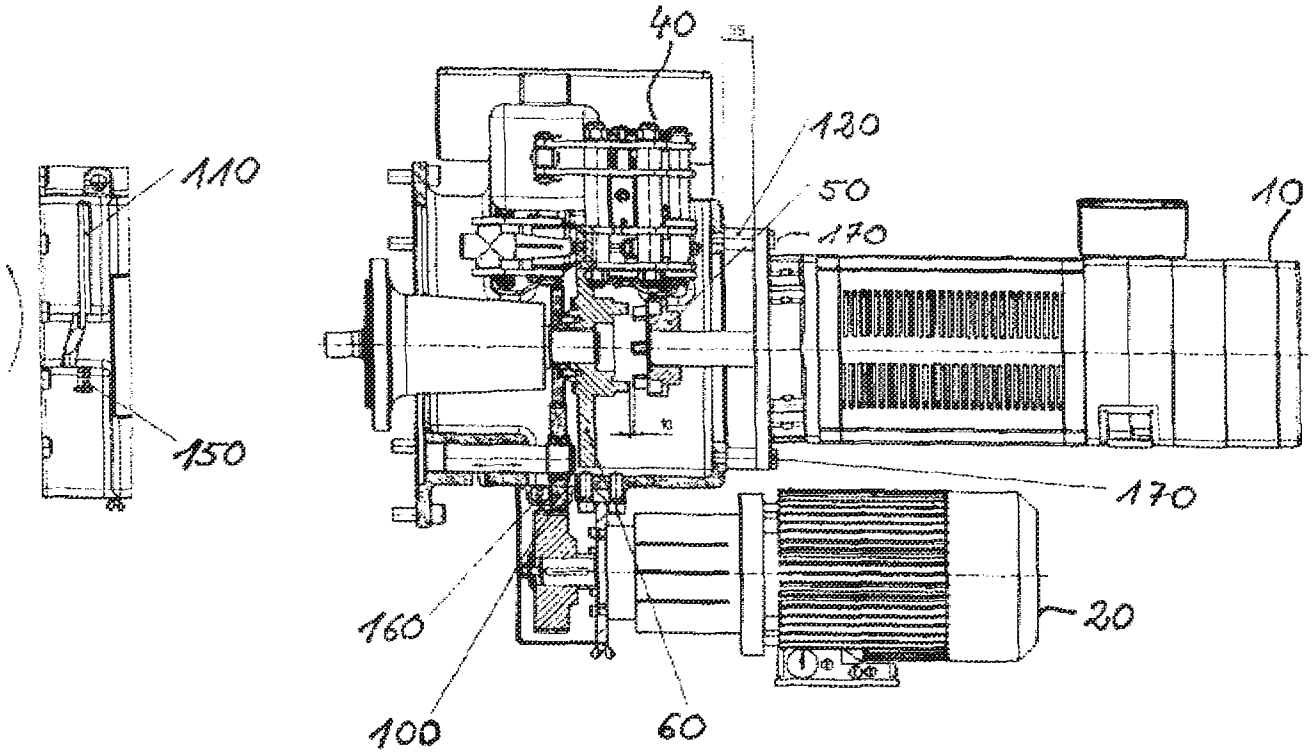
FIG. 3 shows a further sectional representation of the luffing winch according to the invention along the sectional axis A-A of FIG. 1.

The individual technical details of the luffing winch according to the invention will be explained in more detail below with reference to the two FIGS. 2 and 3. FIGS. 2 and 3 show a sectional representation of the luffing winch according to the invention along the sectional axis A-A of FIG. 1, wherein a top view of the luffing winch has been chosen. The main drive 10 is connected with the transmission input shaft 35 of the winch drum 30 via a planetary transmission. By means of the clutch means 50, the main drive 10 can be decoupled from the drive train of the winch drum 30 and the flux of force can be interrupted.

Furthermore, the brake disk 60 of the braking device 40 is firmly arranged on the transmission input shaft, so that the engagement of the braking device 40 into the brake disk 60 generates a braking moment acting on the winch drum 30.

The emergency drive 20 according to the invention is arranged laterally offset to the drive axle of the main drive 10, wherein the drive shafts of the main drive 10 and of the emergency drive 20 extend parallel to each other. At the end of the emergency drive shaft the drive wheel 80 is arranged. The same has at least twice the width of the intermediate gear 100. To generate a flux of force between the emergency drive 20 and the driven wheel 70, the intermediate gear 100 can be coupled in when necessary. By means of the intermediate gear 100, a flux of force from the drive wheel 80 of the emergency drive 20 to the driven wheel 70 of the transmission input shaft 35 can be effected. The corresponding driven wheel 70 for the emergency drive train is sitting on the transmission input shaft 35 before the drum 30.

FIG. 2 shows the luffing winch according to the invention during the normal operation. In this case, the main drive 10 operates properly and drives the winch 30. The emergency drive 20 is shut off and the intermediate gear 100 is not in engagement with the driven wheel 70 of the transmission input shaft 35.

To establish a flux of force from the emergency drive 20 to the transmission input shaft in case of emergency, the intermediate gear 100 is movably mounted in direction of its shaft axis. The gear wheel dimension of intermediate gear 100 and drive wheel 80 is chosen such that a constant engagement of the intermediate gear 100 into the drive wheel 80 is ensured independent of the current intermediate gear position.

When the winch operation should be switched over to the emergency drive 20, the lever mechanism 110 must be actuated by the user. As can be taken from FIG. 3, due to the lever actuation the intermediate gear 100 is shifted to the right in direction of its shaft axis relative to the transmission input shaft 35, until the intermediate gear 100 engages in the driven wheel 70 of the drum 30. The coordinated roof-like toothing of intermediate gear 100 and driven wheel 70 provides for a particularly smooth engagement of the two wheels, so that the application of force required for this purpose is limited. The lever mechanism 110 also can be mounted axially and can be actuated hydraulically, electromechanically or pneumatically.

Since in case of a defect of the main drive 10 a possible blockage of the drive shaft of the main drive 10 cannot be excluded, the main drive 10 preferably can be decoupled from the drive train of the luffing winch. For this purpose, the main drive 10 is disengaged from the transmission input shaft 35 of the drum 30 via slotted spacer bushes 120. Accordingly, the clutch mechanism 50 no longer is in engagement, so that the flux of force from the main drive 10 to the transmission input shaft is interrupted. The adjustment of the main drive 10 is effected via the screws 170.

Figure 4:
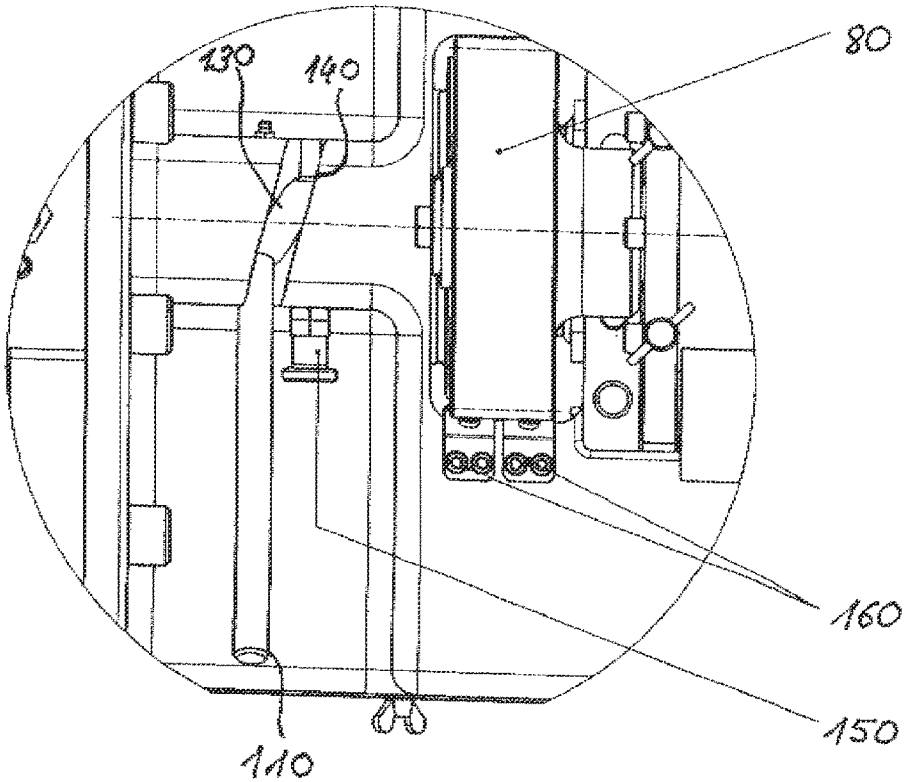
FIG. 4 shows a detail view of the lever mechanism of the luffing winch according to the invention.

FIG. 4 shows a detail representation of the lever mechanism according to the invention for longitudinally shifting the intermediate gear 100. In the foreground, FIG. 4 shows the drive wheel 80 of the emergency drive 20. In parallel offset to the drive wheel 80 of the emergency drive 20, i.e. into the drawing plane, the intermediate gear 100 is concealed. The lever 110 is connected with the oblong intermediate gear receptacle 130, which extends in direction of the intermediate gear shaft axis. When the lever 110 is guided to the upper right through the recess 140 extending upwards at an angle, the intermediate gear 100 is shifted to the right via the receptacle 130 in direction of its shaft axis and brought in engagement with the driven wheel 70. The lever feedback effects the longitudinal displacement of the intermediate gear 100 to the left, whereby the flux of force between intermediate gear 100 and driven wheel 70 is interrupted.

The locking bolt 150, which inhibits the longitudinal displacement of the intermediate gear receptacle 130 in any direction, serves for fixing the intermediate gear position. In the region of the intermediate gear 100, one or more incremental encoders 160 furthermore are arranged for detecting the position of the intermediate gear 100. The current position of the intermediate gear 100 is monitored and communicated to the winch controller by the incremental encoders.

The emergency drive can also be brought in engagement with the shaft via an angular transmission. In addition, both drives can also be of the hydraulic type.

The invention claimed is:

1. A winch, comprising:

a winch drum arranged on a drum shaft;

at least one main drive driving the drum shaft, the main drive arranged coaxially with the winch drum on the drum shaft; and at least one emergency drive driving the drum shaft in case of emergency, the emergency drive comprising a drive wheel, wherein at least one emergency drive is coupleable to a driven wheel of the drum shaft as required via at least one intermediate gear, the intermediate gear in constant engagement with the emergency drive, via the drive wheel, independent of a current position of the intermediate gear and shiftably mounted for coupling in and out in a direction of its shaft axis, the driven wheel arranged on the drum shaft between the winch drum and the main drive.

2. The winch according to claim 1, wherein the at least one intermediate gear is coupleable in or out in the direction of its shaft axis via a lever mechanism.

3. The winch according to claim 1, wherein the at least one intermediate gear is fixed in its position by at least one locking bolt.

4. The winch according to claim 1, wherein a winch brake is arranged coaxially with the main drive and the winch drum on the drum shaft.

5. The winch according to claim 1, wherein toothing of the at least one intermediate gear and/or of the driven wheel is designed as roof-like toothing.

6. The winch according to claim 1, wherein the drive wheel includes at least one hexagon.

7. The winch according to claim 1, further comprising at least one position detector of the intermediate gear.

8. The winch according to claim 1, further comprising one or more slotted spacer bushes for decoupling the main drive.

9. The winch according to claim 1, wherein the winch is a luffing winch of a construction machine.

10. A winch, comprising:

a winch drum arranged on a drum shaft;

at least one main drive driving the drum shaft, the main drive arranged coaxially with the winch drum on the drum shaft; and at least one emergency drive driving the drum shaft in case of emergency, wherein at least one emergency drive is coupleable to a driven wheel of the drum shaft via at least one intermediate gear, the intermediate gear shiftably mounted for coupling in and out in a direction of its shaft axis, the driven wheel arranged on the drum shaft between the winch drum and the main drive;

wherein, when the emergency drive drives the drum shaft, the intermediate gear is shifted along its shaft axis via actuation of a lever mechanism until it engages in the driven wheel, and wherein, when the main drive drives the drum shaft and the emergency drive is shut off, the intermediate gear is not in engagement with the driven wheel.

11. The winch according to claim 10, wherein the intermediate gear is in constant engagement with a drive wheel of the emergency drive independent of a current position of the intermediate gear.

12. The winch according to claim 10, wherein the lever mechanism is connected with an oblong intermediate gear receptacle which extends in the direction of the shaft axis of the intermediate gear, and wherein, upon actuation of the lever mechanism, the receptacle shifts the intermediate gear in the direction of its shaft axis to bring it into engagement with the driven wheel.

13. The winch according to claim 10 further comprising a braking device, the braking device comprising a braking disc arranged coaxially with the main drive and the winch drum on the drum shaft.

14. The winch according to claim 13, wherein engagement of the braking device generates a braking moment acting on the winch drum.

15. The winch according to claim 10, wherein the emergency drive is arranged laterally offset from the drum shaft, and wherein the drum shaft and a drive shaft of the emergency drive extend parallel to each other.

16. The winch according to claim 11, wherein the drive wheel of the emergency drive is arranged at an end of a shaft of the emergency drive.

17. The winch according to claim 1 further comprising a braking device, the braking device comprising a braking disc arranged coaxially with the main drive and the winch drum on the drum shaft.

18. The winch according to claim 11, wherein engagement of the braking device generates a braking moment acting on the winch drum.

19. The winch according to claim 6, wherein the intermediate gear is in constant engagement with the drive wheel independent of a current position of the intermediate gear, and wherein the drive wheel is arranged at an end of a shaft of the emergency drive.

* * * * *